United States Patent [19]

Pedraza

[11] 3,955,700

[45] May 11, 1976

[54] FREIGHT CONTAINER

[75] Inventor: Rafael De Jesus Pedraza, Hialeah, Fla.

[73] Assignee: Omni Equipment, Inc., Opa Locka, Fla.

[22] Filed: June 2, 1975

[21] Appl. No.: 582,616

[52] U.S. Cl. ..... 220/1.5; 220/4 R; 220/72

[51] Int. Cl.[2] ..... B65J 1/02

[58] Field of Search ..... 220/71, 72, 69, 1.5, 220/4 R

[56] References Cited

UNITED STATES PATENTS

| | | | |
|---|---|---|---|
| 3,598,273 | 8/1971 | Rau et al. | 220/4 R X |
| 3,672,529 | 6/1972 | Feddersen et al. | 220/1.5 |
| 3,907,148 | 9/1975 | Meller et al. | 220/4 R X |

*Primary Examiner*—William Price
*Assistant Examiner*—Steven M. Pollard

[57] ABSTRACT

A container is disclosed of that type best suited for carrying air freight in wide bodied aircraft, made to the general specifications of an LD3 Igloo which is essentially a nominal five-foot cube, being extended along one direction perpendicular to the fusillage aircraft to slightly over six feet. The subject container is molded of reinforced fiberglass in a semi-monocoque construction, the door opening being a part of the original molded material. The material is characterized by a plurality of layers of fiberglass and resin including matting, roving, and overlapping matting; criss-crossed webbing being provided at the exterior beneath the overlay matting. Each of the fiberglass members as well as the webbing are separated by a layer of resin. A rail is provided around the periphery of a support pallet having an upstanding container flange to which the fiberglass molded portion is secured. In the method, a split mold is employed with one portion of the split mold being complimentary to the tapered end of the container. The molds are coated with Teflon, the various layers of resin and fiberglass and the webbing being applied exteriorly thereto, and heated for curing from the inside. Upon removal, the one portion of the mold which is rectinlinear in configuration is first removed, and thereafter the tapered portion. Thus a mold can be used which is larger in its assembled form than the opening at the bottom of the enclosed container. The door portion is then sawed out of one end, and framing means secured to the opening and the material which is removed becomes the material for the door. Optionally, the mold sections can be provided with air holes so that air can be used in assisting to strip the molds from the container.

7 Claims, 15 Drawing Figures

FREIGHT CONTAINER

BACKGROUND OF THE INVENTION

1. Field of Invention

The general field of the invention relates to containers, and more particularly, containers which are used in the handling of luggage in passenger aircraft, although also adaptable for the handling of air freight. The specific containers are made to a specification of an approximate 5 foot module, known as the LD3 Igloo.

2. Description of the Prior Art

The containers known in the art, sometimes described as igloos, are provided with a top, a pallet like flat bottom, one flat end and a tapered end, and opposed sides, one of the sides being open or fitted with a closure such as a door. Universally, these containers are made out of aluminum, often times corrugated and reinforced. Considering the fact that these containers are raised and lowered by fork lift trucks or the equivalent, dropped from aircraft onto conveyors in adverse weather conditions, and towed on trailers and the like around complex corners, much rough handling and abuse occurs. Aluminum obviously has little or no memory, and it becomes dented. Often times, jagged edges will appear when a hole is pierced into the aluminum. When such damage occurs, the aluminum igloos are generally taken out of service and repaired if possible. Prior to being taken out of service, however, where jagged tears appear, or rough edges are exposed, the aluminum igloos can damage the luggage which is being shipped. Furthermore, despite the light weight of aluminum, most aluminum igloos made to the 5-foot module of LD3 specification weigh considerably in excess of 300 pounds.

SUMMARY

The present invention relates to a container directed to the LD3 specifications or other specificatons for igloos to be used in aircraft freight handling which have the entire body formed out of reinforced fiberglass including a top, a tapered end portion, a flat end portion, opposed sides, and a pallet bottom. A rail runs around the pallet bottom with an upstanding flange to which the body is secured. The door is formed out of an opening in the reinforced fiberglass side. The reinforced fiberglass is formed of a plurality of layers of resin alternatively in between matting, roving, a woven web, and an overlay matting. By molding the webbing into the container body, and securing the same to the flange on the pallet portion, full containerization is achieved with not only the containing efforts of webbing (often used by itself to contain cargo) but the reinforced fiberglass resin material is sufficiently resilient to resist denting, bending, and the like; and furthermore, can be readily repaired when this occurs. The weight of the resulting container illustrative of the invention is the same or less than aluminum, and the manufacturing cost is significantly less. Furthermore, the reinforced fiberglass is more resistent to salt water, acids, and other contaminants and can be more easily washed.

The method of the invention stems from the utilization of a split mold, one portion of which is tapered to be complimentary to the tapered portion of the container, and the other portion of which is rectilinear to conform to the balance of the interior of the unit. The mold is Teflon coated or otherwise coated with a release agent, and provided with means for heating the same interiorly to excelerate the cure of the plastic. The materials are layed up in the sequence outlined regarding the fiberglass reinforcement with the resin coat to begin with, and a resin coat concluding. After the unit is cured, the large rectilinear portion of the mold is first removed, with the assistance of an air blast if needed, and thereafter, the tapered end complimentary portion is removed. Preferably, one of the sides is cut to the configuration of the door panel desired, and the material, by fitting with appropriate framing and hinging members becomes the door for the container.

It is consequently a primary object of the present invention to fabricate a container of the LD3 variety, or to other configurations as specified by air freight carriers, essentially of a reinforced fiberglass construction both as to the upper portion, and the pallet as well. A related object is to provide such a fiberglass container utilizing the structure of the laminated pallet and method of making the same as disclosed and described in U.S. Pat. No. 3,684,632.

Still another object of the present invention is to provide a container for air freight which is light in weight, resistant to damage, and significantly less expensive than comparable all metal aluminum type containers.

Still another object of the present invention is to provide a container which can be readily and permanently pigmented with colors acceptable by the particular carrier which not only identifies the carrier's luggage handling to the customers but makes it easy to segregate the same for moving around airports where numerous different airlines are handling substantially identically appearing containers because of the identity of the aircraft and specification.

Still another object of the present invention is to provide a container as well as a method for making it which facilitates rapid production and consequent cost saving.

DESCRIPTION OF THE DRAWINGS

Further objects and advantages of the present invention will become apparent as the following description proceeds, taken in conjunction with the accompanying drawings in which.

DESCRIPTION OF A PREFERRED EMBODIMENT

At the outset, it should be pointed out that the specific dimensions and configurations are not critical to the present invention, but rather critical to the utilization of the present invention in the current aircraft, and particularly wide-bodied jets. The specification for the preferred embodiment is that known as LD3. Nominally the base pallet, which is made in accordance with U.S. Pat. No. 3,684,632, is 61.5 inches in the long direction or the direction perpendicular to the longitudinal axis of the fusillage of the aircraft, and 60.4 inches in the other direction. The container itself is approximately 64 inches high, but 79 inches long due to the tapered portion at one end of the pallet.

Figure 1:
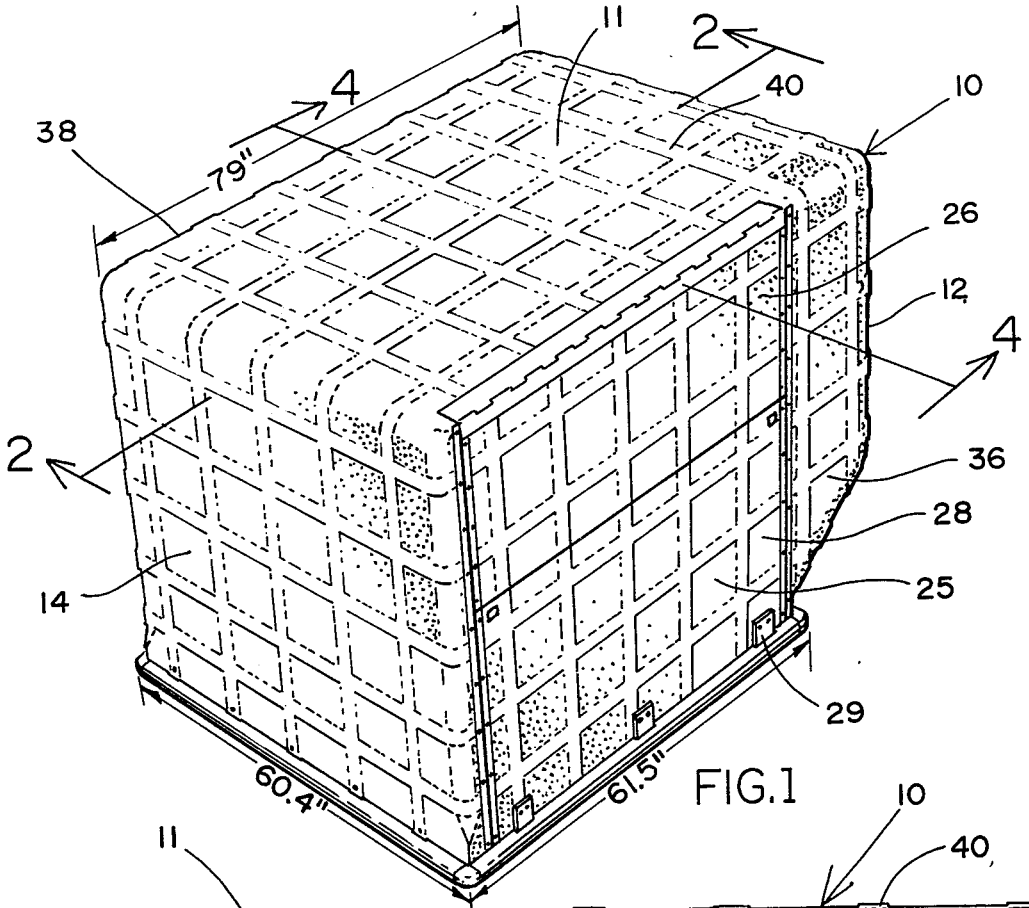
FIG. 1 is a perspective view of a container illustrative of the present invention.
Figure 2:
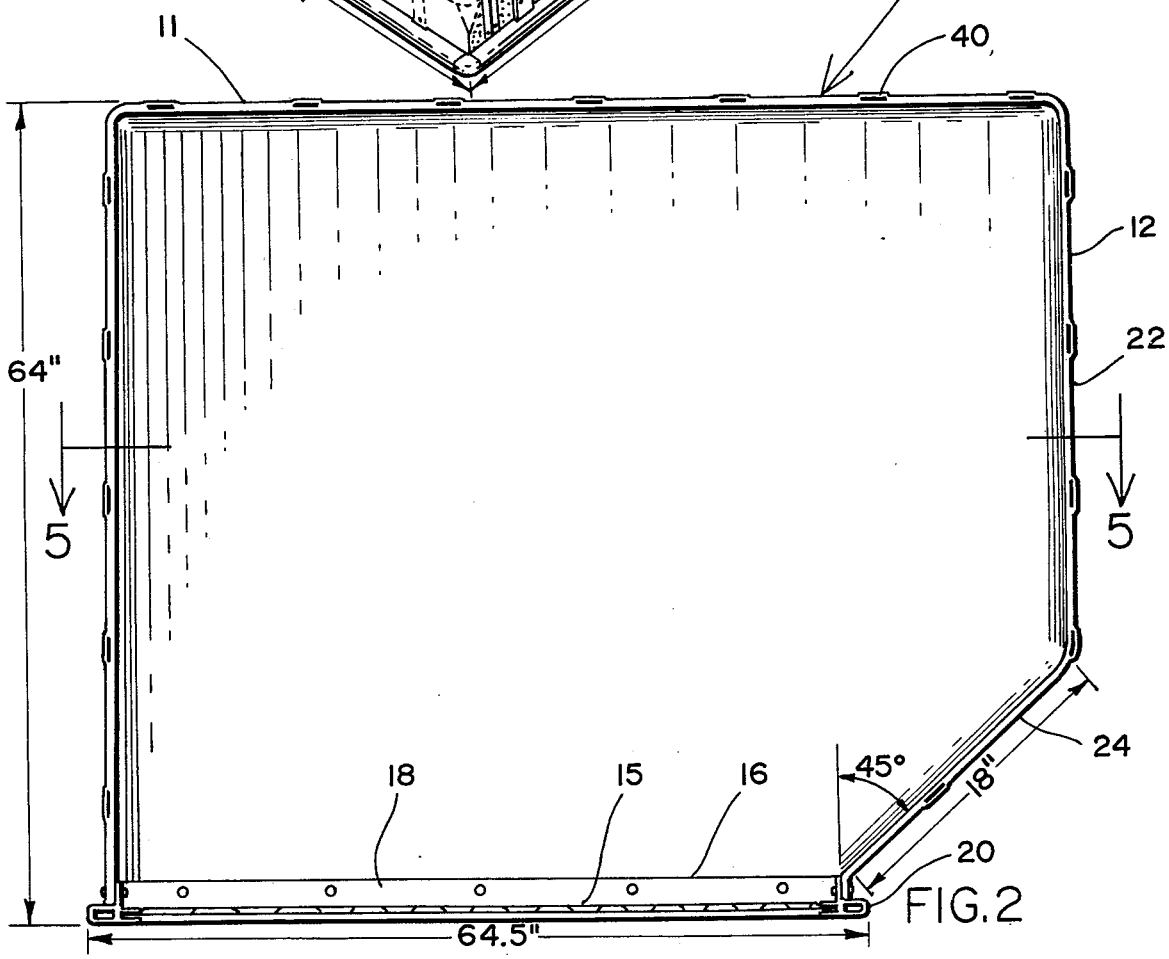
FIG. 2 is an enlarged transverse sectional view of the container in FIG. 1 taken along section line 2—2 in FIG. 1 in somewhat enlarged scale.

Referring now to FIG. 1 of the drawings, it will be seen that a container 10 is disclosed having a top portion 11, a tapered end 12, a flat end 14, and a pallet bottom. The front portion as viewed in FIG. 1 is a door side 36, having a door 25 with an upper section 26, and lower section 28. Fingers 29 are optionally provided at the lower portion of the lower section 28 of the door 25 to fit into the slot 30 provided in the rail 16 which surrounds the pallet bottom 15. Important to achieving the objectives of the invention is the imbedding of the webbing 40 as shown in dotted lines in FIG. 11, and solid lines in the section of FIG. 2. The body of the container 10 is secured to the rail 16 by the upstanding container flange 18, preferably with rivets, and preferably centered through the webbing (see FIG. 6 in this regard) and also with an intermediate rivet between the various webs as they extend downwardly and perpendicularly to the rail 16.

Figure 3:
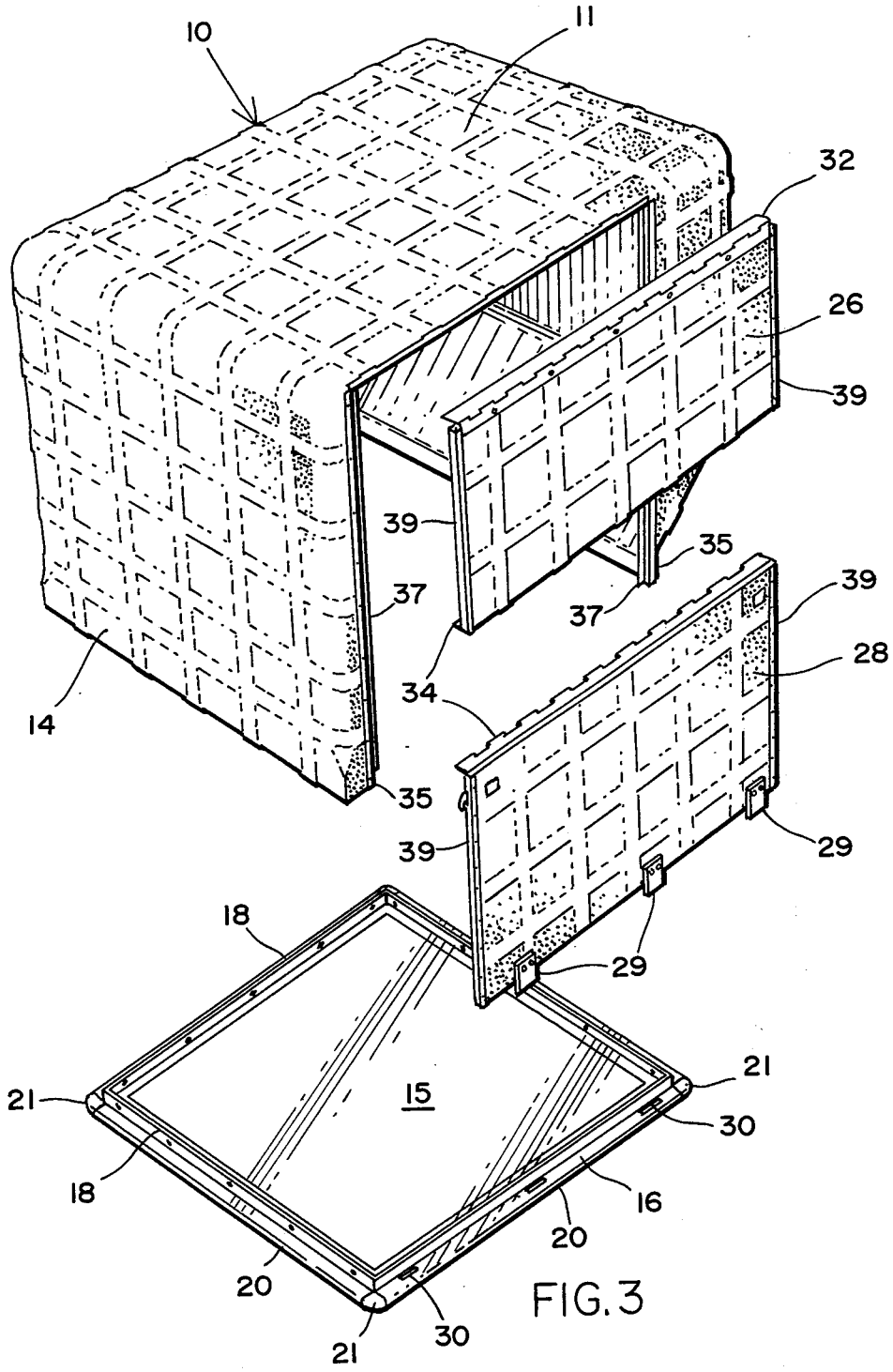
FIG. 3 is an exploded perspective view of the subject matter of the container taken from the same general vantage point as FIG. 1.

In a successfully tested embodiment, the container body weighs approximately 160 pounds, with the pallet and the rail weighing approximately 90 pounds. Another 50 pounds is made up of miscellaneous hardware generally associated with the door construction. As seen in FIG. 3, it will be appreciated that the weight of the upper and lower section of the door 26, 28 as well as its associated hardware can be eliminated if an open-ended container 10 is desired, wherein the opening is closed by a canvas cover, or lightweight webbing, or other types of removable closure means.

Figure 4:
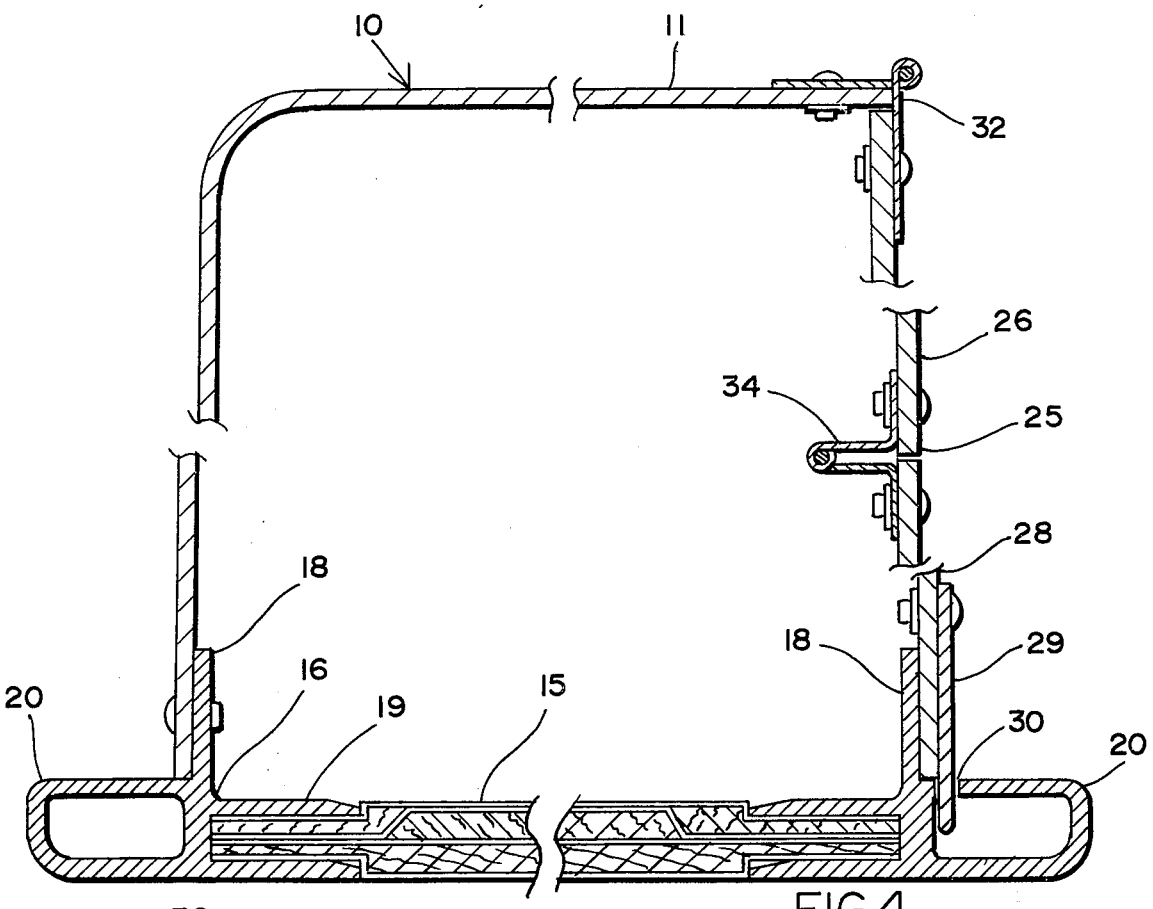
FIG. 4 is an enlarged broken sectional view taken along section line 4—4 of FIG. 1.

The specific attachment means are primarily a function of the configuration of the extruded rail 16 as best shown in FIG. 4. There it will be seen that the upstanding container flange 18 is secured by means of a rivet or bolt to the appropriate side of the container body 10. A clamp edge 20 extends perpendicularly to the container flange 18 and is preferably hollowed to reduce rate without significantly weakening the same. A pair of opposed pallet flanges 19 extend perpendicularly also to the container flange 18, and are secured by means of rivets, preferably flush rivets, to the pallet bottom 15.

Figure 5:
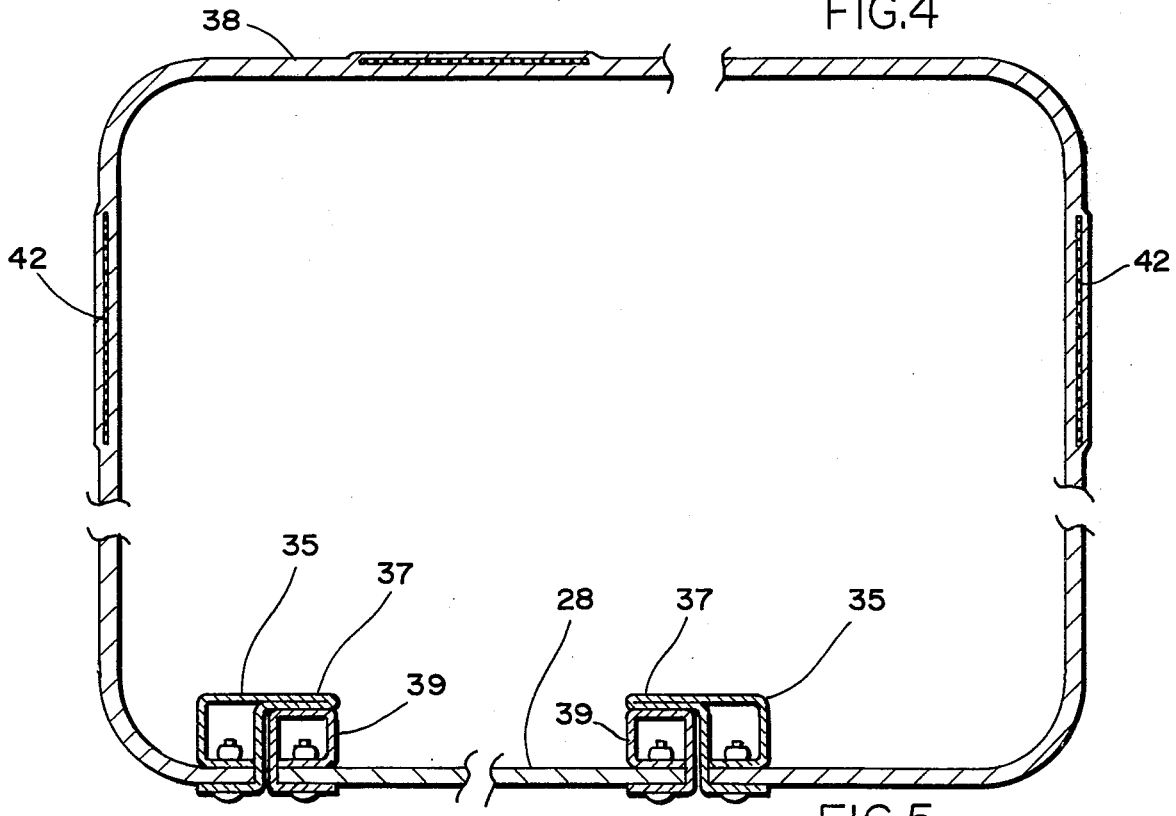
FIG. 5 is a further enlarged broken sectional view taken through the center of the container generally looking downwardly as indicated in section line 5—5 of FIG. 2.

The right hand portion of FIG. 4 illustrates how the finger 29 secured to the lower section 28 of the door 25 is lockingly received within the clamp edge 20 slot 30. The finger 29 is secured by means of a rivet or suitable fastener to the lower section 28 of the door. The upper section 26 of the door is secured at its uppermost portion by means of an upper hinge 32 of the top 11 of the container 10. It will be appreciated that the upper and lower sections 28 of the door are of the same fiberglass material as the balance of the container 10, and cut therefrom. The hinges shown are of a configuration to develop a bifold door which will fold over the top 11 of the container 10 when the container 10 is being filled or loaded. The door 25 is framed by means of door frames 35 as shown in FIG. 5, each of which has a door flat 37 extending centrally of the opening for the door 25. At the edges of both the upper section 26 and the lower section 28 of the door 25, provision is made for reinforcing side frames 39 which abuttingly engage both the door frame and its door flat 37.

Figure 7:
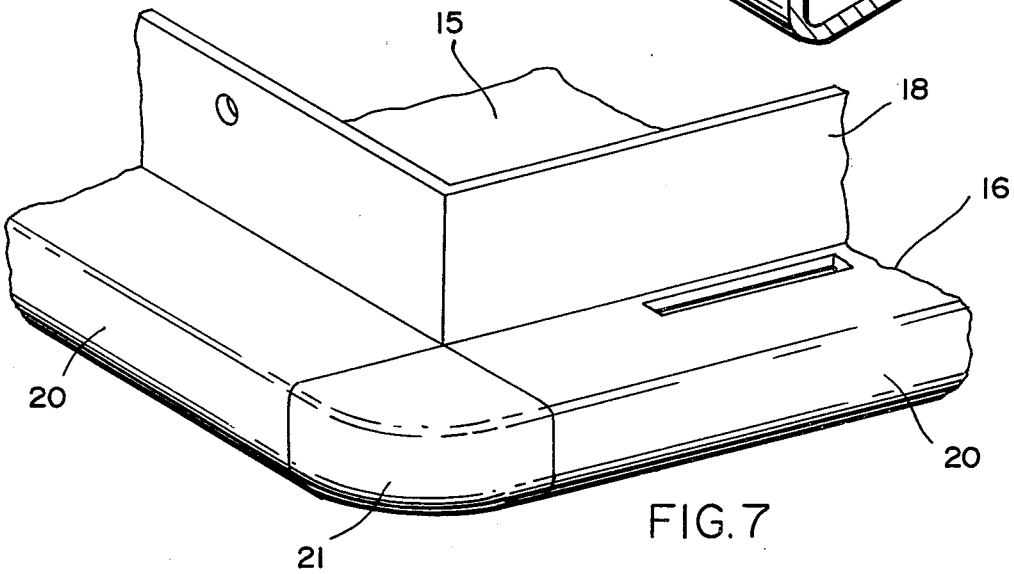
FIG. 7 is a broken perspective view of a corner of the pallet portion showing how the rails are joined at the corners, and also illustrating one finger and slot type locking means for a bifold door.

As shown in FIG. 7 where it will be seen that at the corner of the pallet bottom 15 provision is made for a corner plug 21 to join the rails 16. In this fashion, a smooth rounded corner is provided at each of the four corners of the rails 16 surrounding the pallet bottom 15.

Figure 6:
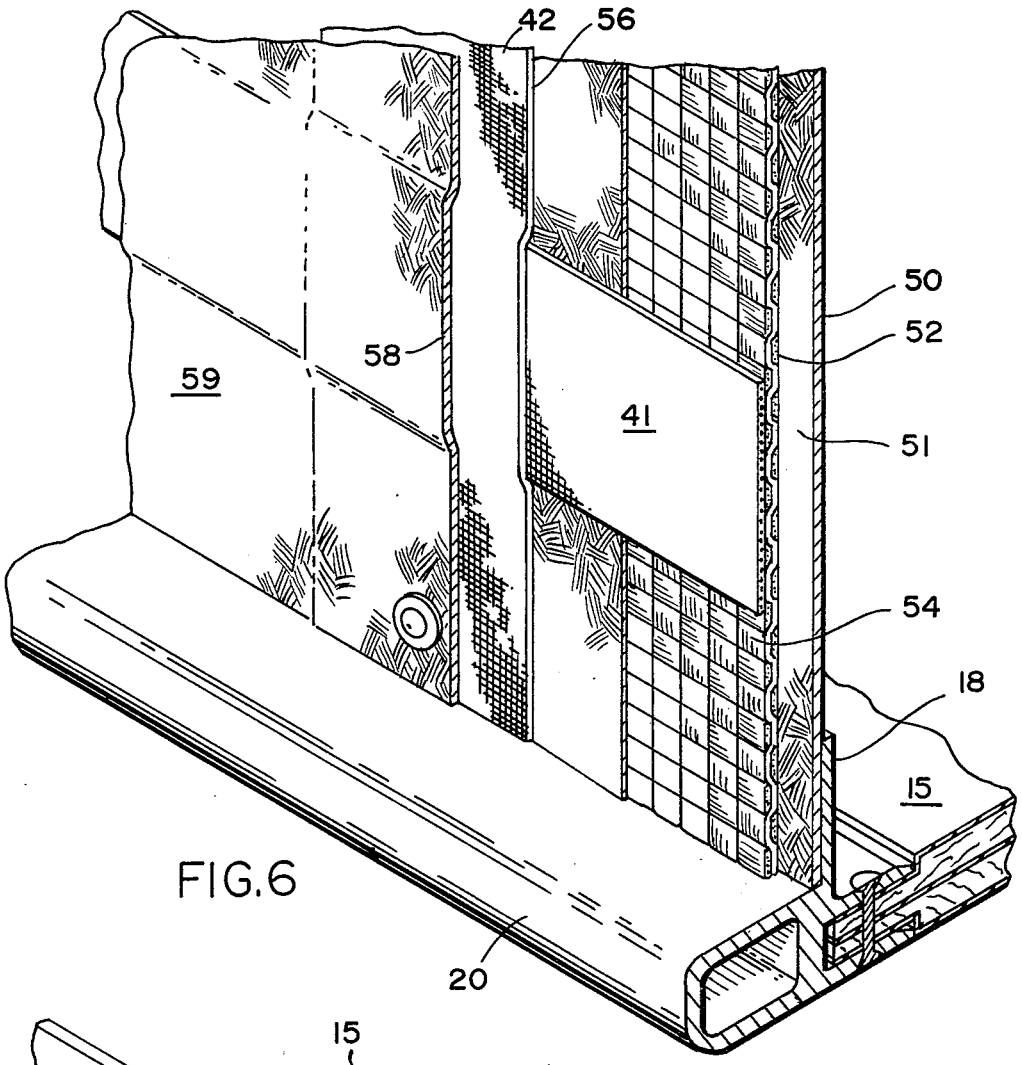
FIG. 6 is an enlarged, partially broken, perspective view taken at the junction of the end of the container and the pallet showing the various layers in the fiberglass construction as well as the pallet rails and the means for joining the container body to the pallet.

The construction of the container 10 is a function of several layers of fiberglass, matting, roving, and strap or webbing which are layed up in sandwich form as shown best in FIG. 6. In all instances, a layer of resin of a commercial grade of polyester resin such as GR12184 is employed with a MEK-60 catalyst to control the rate of setting. The entirety of the construction is layed up around a Teflon coated mold as generally shown in FIGS. 8 through 15, the details of which will be set forth hereinafter. The very first layer is the interior resin 50 a top which a matting 51 is placed before the interior resin 50 cures. The matting is of a commercial grade known in the trade as PPG Mat AKM 1 ½ inches by 60 inches. Thereafter, a matting resin 52 is applied to the outer surface of the mat 51. Subsequently, an application is made of a roving cloth 54 and thereafter a roving cloth resin coat 55. The first portion of the webbing net is then applied by wrapping the horizontal webbing 40 around the entire container 10 preferably on 12 inch centers from the lower portion to the top of the container 10. Thereafter, a horizontal webbing resin 56 is applied followed by the application of the vertical webbing 42 which is also placed on preferably 12 inch centers. After the vertical webbing 42 has been layed up, a further coat of vertial webbing resin 56 is applied, and before it cures, a thin overlay of ¾ inch matting 58 is applied (preferably OFC MAT 700 ¾ inch by 60 inches). Thereafter, a final coat of outer resin 59 is applied to conclude the lay up of the construction of the body portion of the container 10. It will be appreciated that the resins may be pigmented in varying colors, depending upon the preference of the customer. The preferred webbing for the webbing net 40 is a commercial grade of polypropelene webbing generally 2 inches wide and 1/16 inch thick with a tensile strength of 2,500 pounds.

After the entire upper portion of the container 10 is cured on the mold, it is separated therefrom, and the door opening is cut out of the door side 36. The hardward is then secured to the door, whether it is single, bifold as shown, or any other configuration. Thereafter, the container body 10 is positioned atop the pallet bottom 15, and secured by rivets or bolts spaced so that one is centrally positioned in and penetrates each of the vertical webs 42, and the net is positioned mid-way between each of the vertical webs 42, and secured to the container flange 18. Thereafter, the door is assembled, and the unit is complete.

PREFERRED METHOD OF MANUFACTURE

Figure 8:
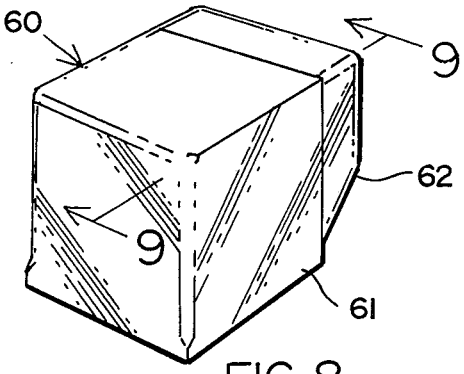
FIG. 8 is a perspective view of the two piece mold utilized in the method of manufacture.
Figure 9:
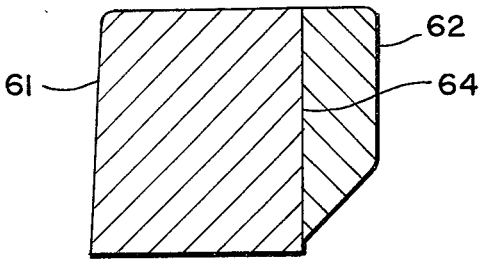
FIG. 9 is a transverse sectional view of the mold taken along section line 9—9 of FIG. 8.
Figure 10:
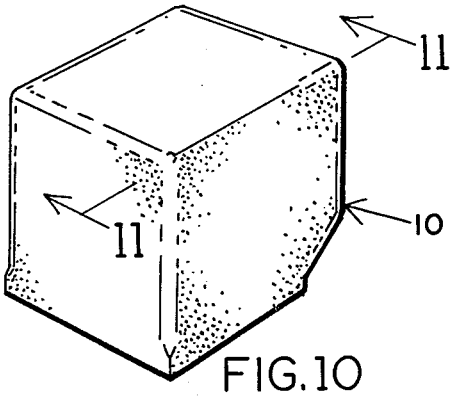
FIG. 10 is a perspective view of the mold after the container body has been formed on the same.
Figure 11:
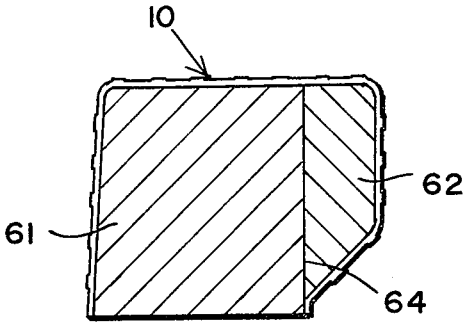
FIG. 11 is a transverse sectional view of the mold and formed container as taken along section line 11—11 of FIG. 10.
Figure 12:
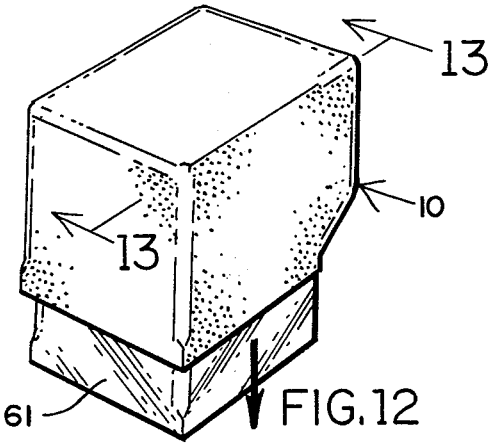
FIG. 12 is a sequential view to that shown in FIG. 10 showing how the large rectilinear portion of the mold is first removed from the container.
Figure 13:
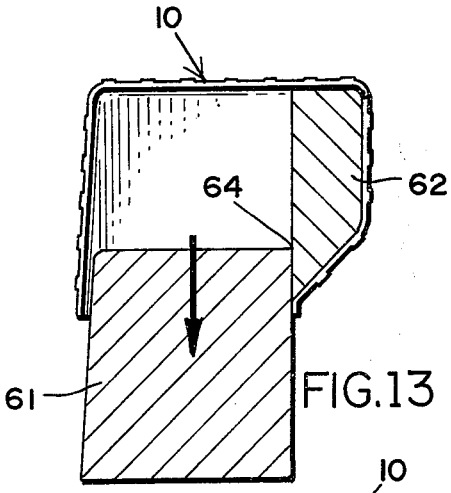
FIG. 13 is a transverse sectional view of the configuration of the mold and removing of the same as illustrated in FIG. 12.
Figure 14:
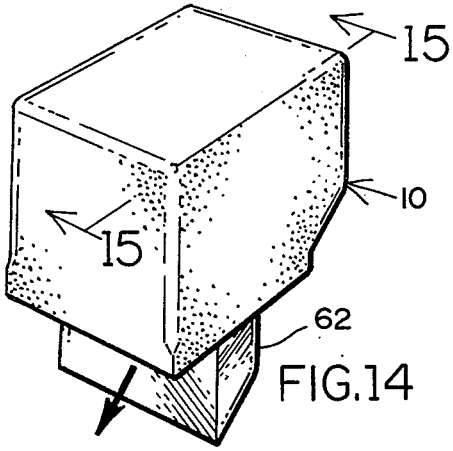
FIG. 14 is a perspective partially diagramatic view showing how the second portion of the mold which is tapered is removed.
Figure 15:
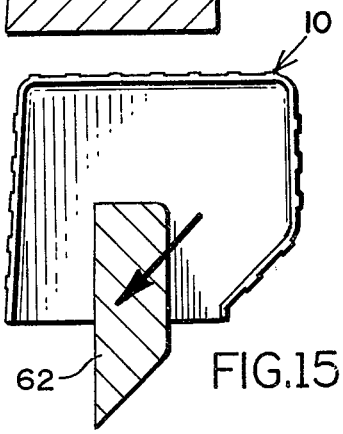
FIG. 15 is a transverse sectional view taken along section line 15—15 of FIG. 14.

The preferred method of manufacture is illustrated in FIGS. 8 through 15 of the drawings. Turning first to FIG. 8, it will be seen that the mold 60 is made up of a rectilinear section 61 and a smaller tapered section 62. The two pieces of the mold are positioned so as to have a common interface 64 as better illustrated in FIG. 9. Once the mold 60 is thus assembled, the resins and matting, roving, and webbing are applied thereto until in the finished form as shown in FIGS. 10 and 11. Thereafter, the rectinlinear mold section 61, as shown in FIG. 12 is withdrawn from the molded container leaving the tapered section 62 still completely contained inside the container 10 as shown in FIG. 13. Once the rectinlinear section 61 is fully withdrawn from the container 10, the tapered mold 62 is then moved forwardly and downwardly out of the container 10 as illustrated in FIGS. 14 and 15. A Teflon coating is preferably applied to the two sections of the mold 60 which will accomplish, with a proper amount of draft, a complete separation of the mold 60 from the interior portion of the container 10. In those instances where stickiness does occur, an interior air pneumatic system may be employed in one or both of the mold sections 61, 62 to present an airblast orifice 65, as best shown in FIG. 13. In addition, the mold sections 61, 62 are hollow, and the lower end of the rectilinear section 61 is open. This permits the positioning of various controlled heating elements interiorly of the rectilinear mold section 61 and indeed, by providing a passageway at the interface 64 between the two molds, the heating can be carried out in a uniform fashion inside the tapered mold section 62 as well.

In review it will be seen that the container as well as the method for making it has been disclosed and described which results in a very sturdy container of the LD3 specified dimensions. The body of the container 10 is fully reinforced and yieldable to the extent that permanent damage by normal bumping is seldom experienced. By the utilization of a good coating technique and preferably aluminum extrusions which are hollowed to the degree possible, a 300 pound container results in which the pallet portion including the rail weighs approximately 90 pounds, the sheet material including the door sheet weighs approximately 160 pounds, and the door hardware weighs 50 pounds, making a completed container, pallet, door, and mounting rails to a specification of 300 pounds. The fiberglass exterior is resistant to most contaminants, and the interior is a smooth molded flat surface of resin which is resistant to snagging luggage, and contained freight as distinguished from convoluted or corrugated metal type containers.

Although particular embodiments of the invention have been shown and described in full here, there is no intention to thereby limit the invention to the details of such embodiments. On the contrary, the invention is to cover all modifications, alternatives, embodiments, usages and equivalents of a container and method of making same as fall within the spirit and scope of the invention, specification and appended claims.

What is claimed is:

1. A container for use in handling airborne freight comprising, in combination, a top, a tapered end at one end thereof tapering inwardly at its lower portion, a flat end opposed to the tapered end, a door side depending from the top and integral at both ends with the tapered end and the flat end, a closed side opposed to the door side and depending from the top and integral with the two ends, a door opening in the door side, a pallet base having a peripheral rail with an upstanding container, means for securing the sides, and ends to said rail, the top, ends and sides being characterized by a plurality of layers of fiberglass and resin, with a horizontal webbing embedded therein, and a vertical webbing embedded therein, means for securing the container body to the pallet base penetrating each of the vertical webs, thereby encircling the container cargo wth an embedded netting.

2. In the container of claim 1 above, the door portion on the door end being cut from the door end when the same is formed, framing means surrounding the area from which the door portion is cut, and means for securing the door in the closed position including members secured to the lower portion of the door, and interlocking with the pallet rail there beneath.

3. A reinforced container comprising, in combination, a top, opposed ends depending from and formed integral with the top, a door side depending from the top and formed integral with the top and both ends, a closed side opposed to the door side and depending from the top and integral with the two ends, a door opening in the door side, a pallet base having a peripheral rail, means for securing the sides, and ends to said rail, the top, ends and sides being characterized by a plurality of layers of fiberglass and resin, with a horizontal webbing embedded therein, and a vertical webbing embedded therein.

4. In the container of claim 3, said sides and ends and top all being joined by radiused intersecting edges.

5. In the container of claim 3, one such end being tapered inwardly and radiused at its lower edge for securement to said container flange.

6. In the container of claim 3, said securing means penetrating the vertical web thereby encircling the container with an embedded netting.

7. In the container of claim 6, said rail having an upstanding flange penetrated by the securing means.

* * * * *

UNITED STATES PATENT OFFICE

CERTIFICATE OF CORRECTION

Patent No. 3,955,700 Dated May 12, 1976

Inventor(s) Rafael de Jesus Pedraza

It is certified that error appears in the above-identified patent and that said Letters Patent are hereby corrected as shown below:

In the Abstract, lines 24 and 25, "rectinlinear" should read -- rectilinear.--.

Column 2, line 2, "excelerate" should read -- accelerate --.

Column 2, line 3, "layed up" should read -- laid up --.

Column 4, line 37, "layed up" should read -- laid up --.

Column 4, line 42, "layed up" should read -- laid up --.

Column 4, line 59, "layed up" should read --laid up --.

Column 5, lines 5 and 6, "hardwood" should read -- hardware--.

Column 5, lines 27 and 31, "rectinlinear" should read --- rectilinear ---.

Signed and Sealed this

Seventh Day of December 1976

[SEAL]

*Attest:*

RUTH C. MASON
*Attesting Officer*

C. MARSHALL DANN
*Commissioner of Patents and Trademarks*